US005862228A

United States Patent [19]

Davis

[11] Patent Number: 5,862,228

[45] Date of Patent: Jan. 19, 1999

[54] AUDIO MATRIX ENCODING

[75] Inventor: Mark Franklin Davis, Pacifica, Calif.

[73] Assignee: Dolby Laboratories Licensing Corporation, San Fransico, Calif.

[21] Appl. No.: 803,676

[22] Filed: Feb. 21, 1997

[51] Int. Cl.[6] ..... H04R 5/00

[52] U.S. Cl. ..... 381/17; 381/61

[58] Field of Search ..... 381/17, 18, 19, 381/20–23, 1, 61, 63

[56] References Cited

U.S. PATENT DOCUMENTS

| | | | |
|---|---|---|---|
| Re. 25,652 | 10/1964 | Kennedy . | |
| 3,170,991 | 2/1965 | Glasgal . | |
| 3,219,757 | 11/1965 | Palladino . | |
| 3,236,949 | 2/1966 | Atal et al. . | |
| 3,238,304 | 3/1966 | Yaita et al. . | |
| 3,249,696 | 5/1966 | Van Sickle . | |
| 3,892,624 | 7/1975 | Shimada . | |
| 4,039,755 | 8/1977 | Berkovitz | 381/63 |
| 4,068,093 | 1/1978 | Fidi . | |
| 4,118,599 | 10/1978 | Iwahara et al. . | |
| 4,139,728 | 2/1979 | Haramoto et al. . | |
| 4,159,397 | 6/1979 | Iwahara et al. . | |
| 4,192,969 | 3/1980 | Iwahara . | |
| 4,199,658 | 4/1980 | Iwahara . | |
| 4,208,546 | 6/1980 | Laupman . | |
| 4,209,665 | 6/1980 | Iwahara . | |
| 4,218,585 | 8/1980 | Carver . | |
| 4,309,570 | 1/1982 | Carver . | |
| 4,356,349 | 10/1982 | Robinson . | |
| 4,388,494 | 6/1983 | Schone et al. . | |
| 4,394,537 | 7/1983 | Shima et al. . | |
| 4,567,607 | 1/1986 | Bruney et al. . | |
| 4,603,429 | 7/1986 | Carver . | |
| 4,625,326 | 11/1986 | Kitzen et al. . | |
| 4,696,035 | 9/1987 | Torelli et al. . | |
| 4,700,389 | 10/1987 | Nakayama . | |
| 4,706,287 | 11/1987 | Blackmer et al. . | |
| 4,782,530 | 11/1988 | Torelli et al. . | |

(List continued on next page.)

FOREIGN PATENT DOCUMENTS

| | | |
|---|---|---|
| 0637191 | 1/1995 | European Pat. Off. . |
| 0664661 | 7/1995 | European Pat. Off. . |
| 57104400 | 6/1982 | Japan . |
| 6-165296 | 6/1994 | Japan . |
| 8-009499 | 1/1996 | Japan . |
| 8-019100 | 1/1996 | Japan . |
| 8-182097 | 7/1996 | Japan . |
| 394325 | 6/1933 | United Kingdom . |
| 781186 | 8/1957 | United Kingdom . |
| 871992 | 5/1991 | United Kingdom . |
| 9401981 | 1/1994 | WIPO . |
| 9606515 | 2/1996 | WIPO . |

*Primary Examiner*—Curtis A. Kuntz
*Assistant Examiner*—Ping W Lee
*Attorney, Agent, or Firm*—Gallagher & Lathrop; Thomas A. Gallagher

[57] ABSTRACT

A surround sound encoder, intended for implementation in software, runs in real time on a personal computer using low mips and a small fraction of available CPU cycles. In the principal application for the encoder, the Lt and Rt signals of the encoder are mixed with the Lt and Rt signals of a pre-recorded source (e.g., computer game soundtrack, CD ROM, Internet audio, etc.). Alternatively, the encoder may be used by itself or with one or more other virtual encoders to provide a totally user-generated soundfield. The encoder is implemented in either of two ways: the signal being encoded may be panned to one or more of the four inputs of a surround-sound fixed matrix encoder or the signal may be encoded by applying the signal to a surround-sound variable-matrix encoder. Phase shifting, required in the encoder, is achieved by applying a signal to two phase-shifting processes, producing two signals whose relative phase difference is sufficiently close to the desired phase shift over at least a substantial part of the frequency band of interest. Satisfactory audible results may be achieved, using very low computer processing power, when one of the phase shifting processes is implemented by a first-order all-pass filter and the other phase shifting process is implemented by only a short time delay, which also has an all-pass characteristic.

6 Claims, 4 Drawing Sheets

U.S. PATENT DOCUMENTS

| | | | |
|---|---|---|---|
| 4,893,342 | 1/1990 | Cooper et al. . | |
| 4,908,858 | 3/1990 | Ohno . | |
| 4,910,778 | 3/1990 | Barton . | |
| 4,910,779 | 3/1990 | Cooper et al. . | |
| 4,975,954 | 12/1990 | Cooper et al. . | |
| 5,034,983 | 7/1991 | Cooper et al. . | |
| 5,052,685 | 10/1991 | Lowe et al. | 381/17 |
| 5,056,149 | 10/1991 | Broadie . | |
| 5,095,507 | 3/1992 | Lowe . | |
| 5,095,787 | 3/1992 | Okada et al. . | |
| 5,136,651 | 8/1992 | Cooper et al. . | |
| 5,173,944 | 12/1992 | Begault . | |
| 5,208,493 | 5/1993 | Lendaro et al. . | |
| 5,301,236 | 4/1994 | Iizuka et al. . | |
| 5,319,713 | 6/1994 | Waller et al. . | |
| 5,333,200 | 7/1994 | Cooper et al. . | |
| 5,381,482 | 1/1995 | Matsumoto et al. . | |
| 5,384,851 | 1/1995 | Fujimori . | |
| 5,412,732 | 5/1995 | Kanishi et al. . | |
| 5,418,856 | 5/1995 | Okamoto . | |
| 5,420,929 | 5/1995 | Geddes et al. . | |
| 5,436,975 | 7/1995 | Lowe et al. . | |
| 5,440,639 | 8/1995 | Suzuki et al. . | |
| 5,517,570 | 5/1996 | Taylor . | |
| 5,524,053 | 6/1996 | Iwamatsu . | |
| 5,533,129 | 7/1996 | Gefvert . | |
| 5,546,465 | 8/1996 | Kim . | |
| 5,553,149 | 9/1996 | Freadman . | |
| 5,579,396 | 11/1996 | Iida et al. . | |
| 5,581,618 | 12/1996 | Satoshi et al. . | |
| 5,598,478 | 1/1997 | Tanaka . | |

AUDIO MATRIX ENCODING

FIELD OF THE INVENTION

The invention relates to audio matrix encoding. More particularly, the invention relates to a computer software implemented 4:2 audio encoding matrix for directionally encoding a digital audio signal while using very low processing resources of a personal computer.

BACKGROUND OF THE INVENTION

Dolby Surround multichannel audio for personal computer-based multimedia video games and CD ROMs has emerged as a new use for the Dolby MP (Motion Picture) matrix, a 4:2:4 amplitude-phase audio matrix. The Dolby MP matrix is well known in connection with Dolby Stereo movies and Dolby Surround video recordings (video tapes and laser discs), broadcast transmissions (radio and television), and audio media (cassettes and compact discs).

An encoder embodying the Dolby MP 4:2 encode matrix combines four channels of audio into an encoded two channel format, suitable for recording or transmitting the same as regular stereo programs, while a Dolby Surround decoder embodying a Dolby MP 2:4 decode matrix recovers four channels of audio from the two encoded channels.

Dolby Surround is a true surround sound system, not just a playback effect. It involves encoding sounds during production to create a pair of Dolby Surround encoded signals (a "soundtrack"), and then decoding the soundtrack on playback using a Dolby Surround decoder. Thus, producers can control the placement and movement of sounds in a way that creates a remarkably realistic experience, drawing the listener into the action.

FIG. 1 is an idealized functional block diagram of a conventional prior art Dolby MP Matrix encoder. The encoder accepts four separate input signals; left, center, right, and surround (L, C, R, S), and creates two final outputs, left-total and right-total (Lt and Rt). The C input is divided equally and summed with the L and R inputs with a 3 dB level reduction in order to maintain constant acoustic power. The L and R inputs, each summed with the level-reduced C input, are phase shifted in respective identical all pass networks located between first and second summers in each path. The S input is also divided equally between Lt and Rt with a 3 dB level reduction, but it first undergoes three additional processing steps (which may occur in any order):

a. frequency bandlimiting from 100 Hz to 7 kHz; and b. encoding with a modified form of Dolby B-type noise reduction.

The processed S input is then applied a third all pass network, the output of which is summed with the phase-shifted L/C path to produce the Lt output and subtracted from the phase-shifted R/C path to produce the Rt output. Thus, the surround input S is fed into the Lt and Rt outputs with opposite polarities. In addition, the phase of the surround signal S is about 90 degrees with respect to the LCR inputs. It is of no significance whether the surround leads or lags the other inputs. In principle there need be only one phase-shift block, say −90 degrees, in the surround path, its output being summed with the other signal paths, one in-phase (say Lt) and the other out-of-phase (inverted) (say Rt). In practice, as shown in FIG. 1, a 90 degree phase shifter is unrealizable, so three all-pass networks are used, two identical ones in the paths between the center channel summers and the surround channel summers and a third in the surround path. The networks are designed so that the very large phase-shifts of the third one are 90 degrees more or less than those (also very large) of the first two.

The left-total (Lt) and right-total (Rt) encoded signals may be expressed as $$Lt=L+0.707C+0.707jS'; \text{ and}$$

$$Rt=R+0.707C-0.707jS',$$

where L is the left input signal, R is the right input signal, C is the center input signal and S' is the band-limited and noise reduction encoded surround input signal S. In the above equations and in other equations in this document, a term (such as 0.707 jS') containing "j" represents a signal phase-shifted 90 degrees with respect to other terms.

Audio signals encoded by a Dolby MP matrix encoder may be decoded by a Dolby Surround decoder—a passive surround decoder, or a Dolby Pro Logic decoder—an active surround decoder. Passive decoders are limited in their ability to place sounds with precision for all listener positions due to inherent crosstalk limitations in the audio matrix. Dolby Pro Logic active decoders employ directional enhancement techniques which reduce such crosstalk components.

FIG. 2 is an idealized functional block diagram of a passive surround decoder suitable for decoding Dolby MP matrix encoded signals. The heart of the passive matrix decoding process is a simple L-R difference amplifier. Except for level and channel balance corrections, the Lt input signal passes unmodified and becomes the left output. The Rt input signal likewise becomes the right output. Lt and Rt also carry the center signal, so it will be heard as a "phantom" image between the left and right speakers, and sounds mixed anywhere across the stereo soundstage will be presented in their proper perspective. The center speaker is thus shown as optional since it is not needed to reproduce the center signal. The L-R stage in the decoder will detect the surround signal by taking the difference of Lt and Rt, then passing it through a 7 kHz low-pass filter, a delay line, and complementary modified Dolby B-type noise reduction. The surround signal will also be reproduced by the left and right speakers, but it will be heard out-of-phase which will diffuse the image. In order properly to reproduce the decoded surround sound signal, the surround signal is ordinarily reproduced by one or more surround speakers located to the sides of and/or to the rear of the listener.

Dolby Surround multichannel sound is also employed to encode the audio of many personal-computer-based multimedia video games and CD ROMs. When played on personal computers having Dolby Surround decoders and suitable loudspeakers, the computer user experiences the same sort of multichannel surround sound as he or she has known in Dolby Surround home theatre.

One important difference between the computer-based and home theatre experiences is that the former usually are interactive, requiring the real-time involvement of the user. Typically, a manual input (joystick, mouse, keyboard, etc.) initiated by the computer user causes a change in the displayed video and/or audio. In order to enhance the realism of the interactivity, it would be desirable for user actions to result not merely in the creation of additional sound effects in real time, but for such sound effects to have variable spatial positions determined in real time.

Accordingly, there is a need to spatially encode one or more sounds in real time for mixing with a pre-recorded surround-sound soundtrack (the soundtrack of a computer game, a CD ROM or Internet audio, for example). Further, there is a need to accomplish such encoding as simply as possible, using as few computing resources as possible.

SUMMARY OF THE INVENTION

In accordance with the present invention, a surround sound encoder is provided, intended for implementation in software, such that when run in real time on a personal computer, the encoder has very low mips requirements and uses a small fraction of available CPU cycles. The present encoder provides for the real time surround encoding of a single audio signal (multiple copies of such encoders in software will handle multiple audio signals) for mixing with a pre-recorded soundtrack such that the user-interaction-enhanced soundtrack may be played back via a Dolby Surround decoder or a Dolby Surround Pro Logic decoder (or, if full compatibility is not a concern, by other types of 2:4 matrix decoders).

In its basic configuration, the encoder of the present invention omits two of the processing steps of a conventional Dolby Surround encoder—frequency bandlimiting from 100 Hz to 7 kHz and encoding with a modified form of Dolby B-type noise reduction. Because the present encoder is used to add additional sound effects to a pre-recorded soundtrack, the omission of these two processing steps is inaudible to most listeners. However, if the use of additional computer processing resources is not of concern, the present encoder may include either or both of these two processing steps.

The encoder of the present invention may be implemented in either of two ways: the signal being encoded may be panned to one or more of the four inputs of a surround-sound fixed matrix encoder implemented in software or the signal may be encoded by applying the signal to a surround-sound variable-matrix encoder implemented in software. In the first case, the spatial position of the audio signal to be encoded controls how the signal is proportioned among the four inputs. In the second case, the spatial position of the audio signal to be encoded varies the matrix parameters. Although the two ways are not equivalent, they produce the same encoded Lt and Rt in response to an applied audio signal and positional information.

Although in the principal application for the present encoder, the Lt and Rt signals of the encoder are mixed with the Lt and Rt signals of the pre-recorded source (e.g., computer game soundtrack, CD ROM, Internet audio, etc.), the encoder of the present invention may be used by itself or with one or more other virtual encoders, for example, to provide a totally user-generated soundfield.

In both implementations of the present invention, phase shifting, which is essential to audio phase-amplitude matrix encoding, is achieved in a way that minimizes usage of the processing resources of the encoding computer. Phase shifting is achieved by applying a signal to two phase-shifting processes, producing two signals whose relative phase difference is sufficiently close to the desired phase shift over at least a substantial part of the frequency band of interest. The present inventor has found that satisfactory audible results may be achieved, using very low computer processing power, when one of the phase shifting processes is implemented by a first order all pass filter and the other phase shifting process is implemented by only a short time delay (which also has an all pass characteristic). More accurate phase shifting may be achieved by adding, in series, one or more all pass filters in each phase shifting process and/or by using higher order all pass filters.

DETAILED DESCRIPTION OF THE PREFERRED EMBODIMENTS

Figure 3:
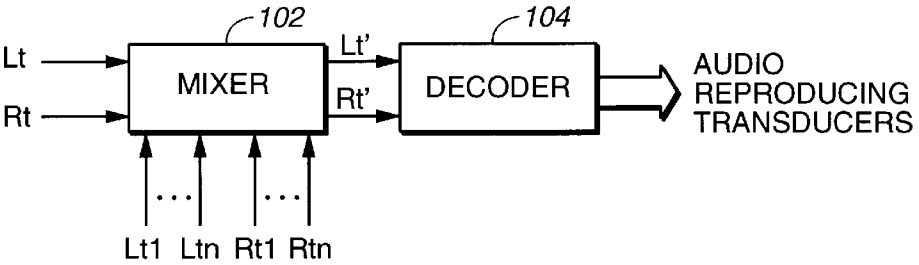
FIG. 3 is a functional block diagram showing the manner in which pre-recorded Lt and Rt matrix-encoded audio signals may be mixed with one of more sets of real-time-generated matrix-encoded audio signals Lt1/Rt1 through Ltn/Rtn to produce composite Lt' and Rt' signals which are decoded in an audio matrix decoder and applied to audio transducers for playback.
Figure 4:
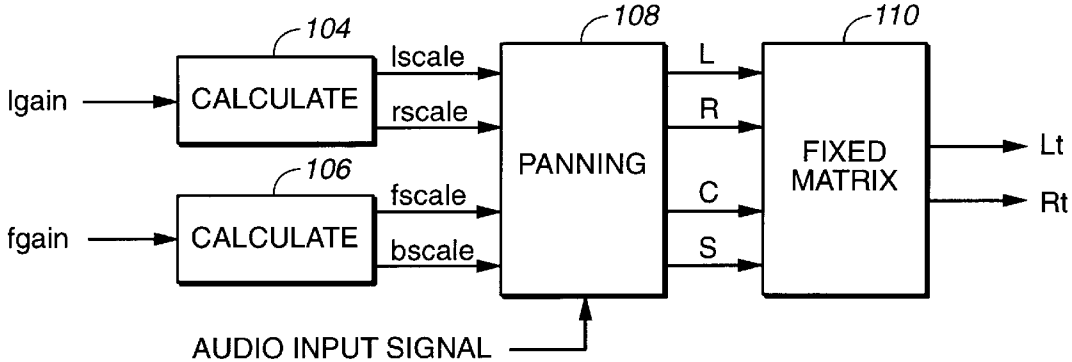
FIG. 4 is a functional block diagram showing the way an audio signal is applied to a variable panner, the panning of which is controlled by scale factors representing the spatial position of an audio signal relative to four directions and calculated from a pair of directional signals, the panner's input controlling the relative levels of the audio signal applied to each of four inputs of a fixed audio matrix.
Figure 5:
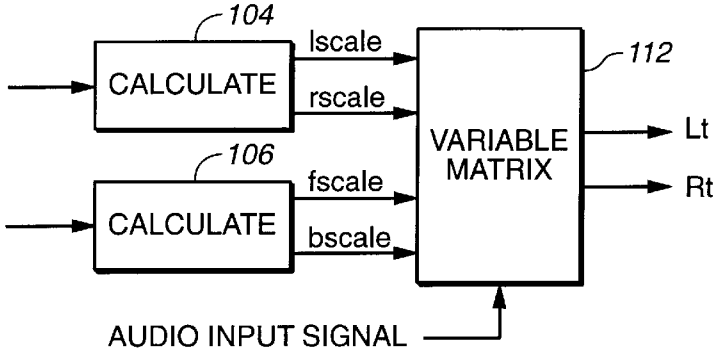
FIG. 5 is a functional block diagram showing the way an audio signal is applied to a variable audio matrix, the characteristics of which are controlled by scale factors calculated from a pair of directional signals representing the spatial position of an audio signal relative to four directions.

An overview of the environment in which the audio matrix encoder of the present invention operates is shown in FIGS. 3, 4, and 5. In FIG. 3, pre-recorded Lt and Rt matrix-encoded audio signals are applied to a linear mixer 102. Other inputs to the mixer include one or more pairs of matrix-encoded audio signals Lt1/Rt1 through Ltn/Rtn. In the preferred environment of the invention, each of the latter inputs represents the spatial encoding of a single audio signal. The output of the mixer 102 is a single pair of matrix-encoded audio signals, Lt' and Rt', representing the linear sum of Lt and Lt1 through Ltn and the linear sum of Rt and Rt1 through Rtn, respectively. The mixer outputs Lt' and Rt' are then decoded in an audio matrix decoder 104 and applied to audio transducers (not shown) for playback. Neither the decoder, the audio transducers nor the mixer form a part of the present invention.

Although the invention is primarily intended for use in adding one or more real time directional audio signals to pre-recorded signals, the invention may be used in other environments. For example, the pre-recorded inputs may be omitted. The encoder may also be used for authoring.

The encoder of the present invention generates the one or more real time matrix-encoded audio signals Lt1 through Ltn and Rt1 through Rtn in the manner shown generally in FIG. 4 or in the manner shown generally in FIG. 5.

In FIG. 4, two control inputs (lgain and fgain) represent the spatial position of an audio signal relative to four directions. The lgain and fgain control inputs ultimately encode the spatial position of an audio signal as phase and amplitude levels in the encoded one Lt/Rt pair of the Lt1 . . . n and Rt1 . . . n outputs.

In the preferred environment, the control inputs are generated by a computer and a computer program in response to manual inputs by a computer user (the user, for example, playing a computer game or a CD ROM or interacting with a site or other users on the Internet). The computer and computer program also generate the input audio signal (alternatively, the real time audio signal may be derived from another source). A set of two scaling factors (lscale and rscale) are calculated by calculate functions 104 and 106 from the lgain input and another set of two scaling factors (fscale and bscale) are calculated from the fgain input. The four scaling factors are then applied to a panner 108 which also receives the input audio signal. The panner 108 controls the relative levels of the audio signal applied to each of four inputs of a fixed audio matrix 110.

In FIG. 5 the four scaling factors are also calculated from two control inputs by calculating functions 104 and 106. However, in a manner different from the processing in FIG. 4, the scaling factors then control the characteristics of a variable matrix 112 which also receives the input audio signal to directionally encode the input audio signal into the Lt1 . . . n and Rt1 . . . n output signals.

An embodiment of the panning 108 and fixed matrix 110 of FIG. 4 are described in connection with FIG. 6. Control variables used as inputs to the routine are lgain, which varies from 1.0 Left to 0.0 Right, and fgain, varying from 1.0 Front to 0.0 Back. These control variables are generated, for example, by the computer game or CD ROM running on the computer or by some other source. Although the lgain and fgain control variables represent two orthogonal directions in two-dimensional space (front/back and left/right) for compatibility with Dolby Surround and Dolby Pro Logic Surround decoders, in principle they are not so limited. In their simplest and lowest processing power version, calculation functions 152 and 154, respectively, calculate four scale factors lscale, rscale, fscale, and bscale from fgain and lgain in accordance with the following relationships which describe two linear panning functions in which the division of the amplitude between left/right and front (center)/back (surround), respectively, yields a constant sum:

lscale=lgain;

rscale=1.−lscale;

fscale=fgain; and bscale=1.−fscale.

Although the four scale factors represent a spatial position relative to four directions, it should be understood that they do not have four degrees of freedom inasmuch as they are derived from control variables having only two degrees of freedom.

Figure 1:
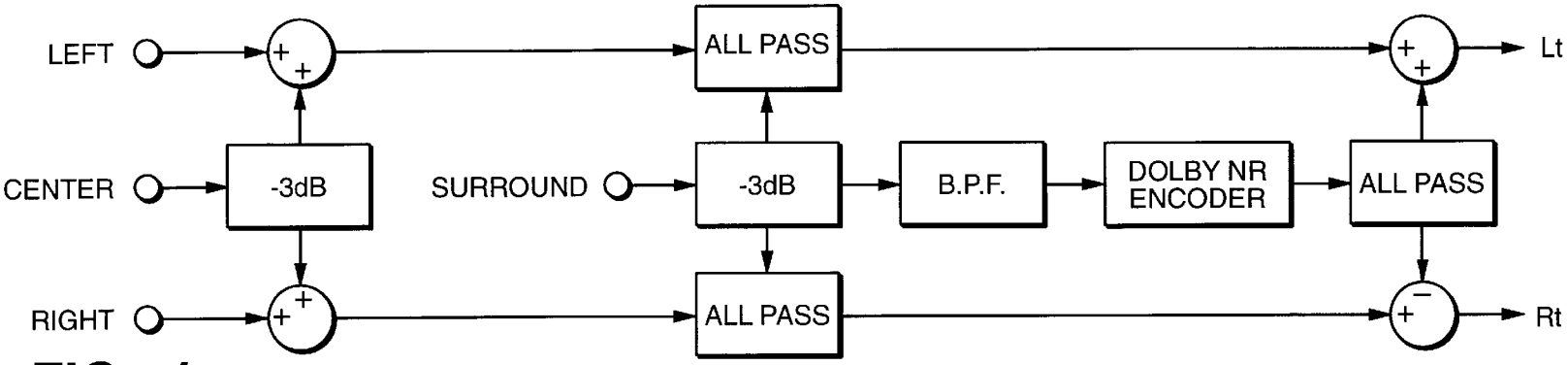
FIG. 1 (PRIOR ART)
FIG. 1 is an idealized functional block diagram of a conventional prior art Dolby MP Matrix encoder.
Figure 2:
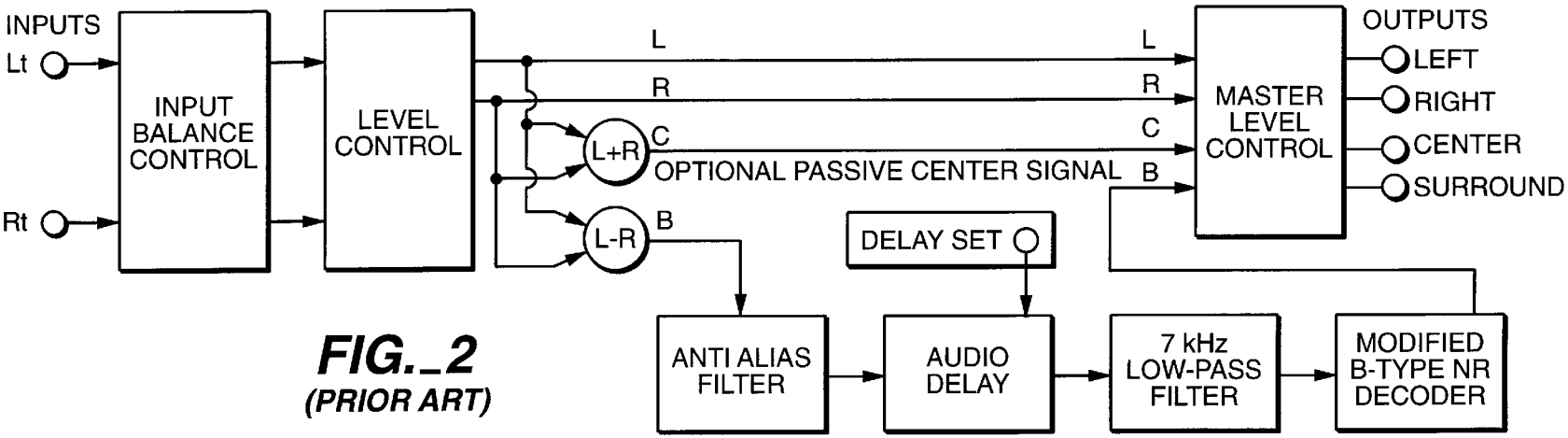
FIG. 2 (PRIOR ART)
FIG. 2 is an idealized functional block diagram of a prior art passive surround decoder suitable for decoding Dolby MP matrix encoded signals.

Calculation of the four scale factors by two linear panning functions results in encoding center and surround signals at a −6 dB level rather than −3 dB as in the classical prior art Dolby MP Matrix encoder (see FIG. 1). In this case the encoded signals may be expressed as Lt=L+0.5C+0.5jS; and Rt=R+0.5C−0.5jS, where L is the left input signal, R is the right input signal, C is the center input signal and S is the surround input signal.

In the typical application for this invention (adding one or more spatial effect signals to a conventionally encoded prerecorded soundtrack), the 3 dB difference (−6 dB vs. −3 dB) is likely to be inaudible to most listeners. However, if the use of additional computer processing resources is not of concern, a sine/cosine panning function instead of a linear panning function may be employed to calculate lscale and rscale (thus requiring the use of multipliers rather than simply shifting the binary point). Thus, in this alternative, calculation functions 152 and 154, respectively, calculate scale factors lscale, rscale, fscale, and bscale from fgain and lgain in accordance with the following relationships:

lscale=sin (lgain*pi/2);

rscale=sqrt(1.−lscale*lscale);

fscale=fgain; and bscale=1.−fscale.

In this and other expressions throughout this document, the star symbol ("*") indicates a multiply operation, the plus symbol ("+") indicates an add operation and the minus symbol ("−") indicates a subtraction operation (which may be implemented, for example, by a sign inversion and an add operation).

In this case, the center signals are encoded at a −3 dB level and surround signals are encoded at a −6 dB level. Thus, the encoded signals may be expressed as Lt=L+0.707C+0.5jS; and Rt=R+0.707C−0.5jS.

The use of a linear panning function to calculate fscale and bscale is much less likely to be audible than with respect to lscale and rscale—but if desired, a sine/cosine panning function may also be used to calculate fscale and bscale to yield the classical Dolby MP Matrix encoding expressions:

Lt=L+0.707C+0.707jS; and

Rt=R+0.707C−0.707jS.

To avoid unduly consuming CPU cycles, scale factor calculation may be carried out only for blocks of time samples. Because the sound image position is constant for the time period of each block, if the blocks are too long in time duration, the sound image may move in perceptible jumps. Thus, the audible effect of block length must be weighed against savings in required processing power. The perception of smooth movement in the decoded sound image may also be enhanced by incrementally changing the scale factors periodically, even once per sample, without incurring seriously increased mips requirements.

The four scale factors lscale, rscale, fscale and bscale, respectively, are applied to the variable panning function implemented as four multipliers or scalers 156, 158, 160 and 162. The input audio signal is multiplied by lscale in scaler 156 and applied to the left input L of the fixed audio matrix function; the input audio signal is multiplied by rscale in scaler 158 and applied to the right input R of the fixed audio matrix function; the input audio signal is multiplied by fscale in scaler 160 and applied to the center input C of the fixed audio matrix function; and the input audio signal is multiplied by bscale in scaler 162 and applied to the surround input S of the fixed audio matrix function.

The fscale scaled input signal applied to the center C input is added to the left L input signal in summing function 166 and to the right R input signal in summing function 168. The summed L and C signals from summing function 166 and the summed R and C signals from summing function 168 are processed, respectively, by identical or substantially identical all pass functions 172 and 174. The surround S input signal is processed by all pass function 176.

Each of the all pass functions 172, 174 and 176 has a substantially non-varying amplitude response characteristic and phase shift which varies with frequency. The sampling rate of the digital audio signal is not critical. A rate of 44.1 kb/s is suitable for compatibility with other digital audio sources and to provide sufficient frequency response for high fidelity reproduction.

In the simplest and lowest processing power version of the fixed matrix 110, one of the phase shifting processes (172 or 174/176) is implemented by a first order all pass filter and the other phase shifting process (176 or 172/174) is implemented by only a short time delay. A pure time delay exhibits an all pass characteristic and is particularly economical when performed in the digital domain. The two resulting outputs are sufficiently close to averaging 90 degrees apart in phase as to provide audibly acceptable decoding at least across the frequency range of 200 Hz to 10 kHz where the effect of the phase shifting is likely to be audible. Departures from the ideal 90 degrees will only affect the apparent imaging when the source is directed somewhere between front and surround, where the imaging is vague anyway; surround-only signals are accurately out-of-phase whatever the characteristic of the phase-shifter, and images at the front do not depend on the phase-shifter.

More accurate phase shifting (i.e., closer to 90 degrees over the same or a wider frequency range) may be achieved by adding, in series, one or more non-pure-delay all pass filter functions (i.e., involving one or more multiply-add functions in addition to one or more delays) in each phase shifting process and/or by using higher order all pass filters (a second order all pass filter uses only slightly more processing power than does a first order filter). Although the phase shifting process having the pure delay may be in either process 172/174 or 176, for simplicity in explanation and to minimize processing resources, the following description assumes that the pure delay is in processes 172 and 174.

In the simplest and lowest processing power version of the fixed matrix 110, the non-pure-delay all pass function 176 may be implemented as a simple first order filter stage:

$$out(i)=C1*in(i)+in(i-1)+C2*out(i-1),$$

where, C2=0.9289 and C1=−C2, assuming fsampling=44100 Hz. All pass network 176 applies a frequency-dependent phase shift that varies monotonically from 0 degrees at DC to −180 degrees at the Nyquist frequency.

The pure time delay in functions 172 and 174 may be implemented by a ring buffer of length 3, also assuming 44100 Hz sampling.

The attenuated phase-shifted S input signal is added to the phase shifted sum of the L and attenuated C signals by a summing function 176 to produce the Lt output signal. The attenuated phase-shifted S input signal is also sign inverted and added to the phase shifted sum of the R and attenuated C signals by a summing function 178 to produce the Rt output signal. The sign inversion may be accomplished in many ways. One processingly economical method would be to multiply by minus one before adding in function 178.

An embodiment of the variable matrix 112 of FIG. 5 is described in connection with FIG. 7. The preferred embodiment of the invention is a variable matrix. A digital audio signal, the input signal, is processed by first and second all pass functions 202 and 204, respectively. Each of the all pass functions has a substantially non-varying amplitude response characteristic and phase shift which varies with frequency. The sampling rate of the digital audio signal is not critical. A rate of 44.1 kb/s is suitable for compatibility with other digital audio sources and to provide sufficient frequency response for high fidelity reproduction.

In the simplest and lowest processing power version of the variable matrix 112, one of the phase shifting processes is implemented by a first order all pass filter and the other phase shifting process is implemented by only a short time delay. A pure time delay exhibits an all pass characteristic and is particularly economical when performed in the digital domain. The two resulting outputs are sufficiently close to averaging 90 degrees apart in phase as to provide audibly acceptable decoding at least across the frequency range of 200 Hz to 10 kHz where the effect of the phase shifting is likely to be audible. Departures from the ideal 90 degrees will only affect the apparent imaging when the source is directed somewhere between front and surround, where the imaging is vague anyway; surround-only signals are accurately out-of-phase whatever the characteristic of the phase-shifter, and images at the front do not depend on the phase-shifter.

More accurate phase shifting (i.e., closer to 90 degrees over the same or a wider frequency range) may be achieved by adding, in series, one or more non-pure-delay all pass filter functions (i.e., involving one or more multiply-add functions in addition to one or more delays) in each phase shifting process. Although the phase shifting process having the pure delay may be in either process 202 or 204, for simplicity in explanation, the following description assumes that the pure delay is in process 204.

In the simplest and lowest processing power version of the variable matrix 112, the non-pure-delay all pass function 202 may be implemented as a simple first order filter stage:

$$out(i)=C1*in(i)+in(i-1)+C2*out(i-1),$$

where, C2=0.9289 and C1=−C2, assuming fsampling=44100 Hz. All pass network 202 applies a frequency-dependent phase shift that varies monotonically from 0 degrees at DC to −180 degrees at the Nyquist frequency.

The pure time delay function 204 may be implemented by a ring buffer of length 3, also assuming 44100 Hz sampling.

In the program code, the allpass signal from process 202 may be stored in array fbuf90 [], and the delayed signal from process 204 in array fbuf []:

```
fbuf90[i]=out(i);
fbuf[i]=in(i-3)
```

Figure 6:
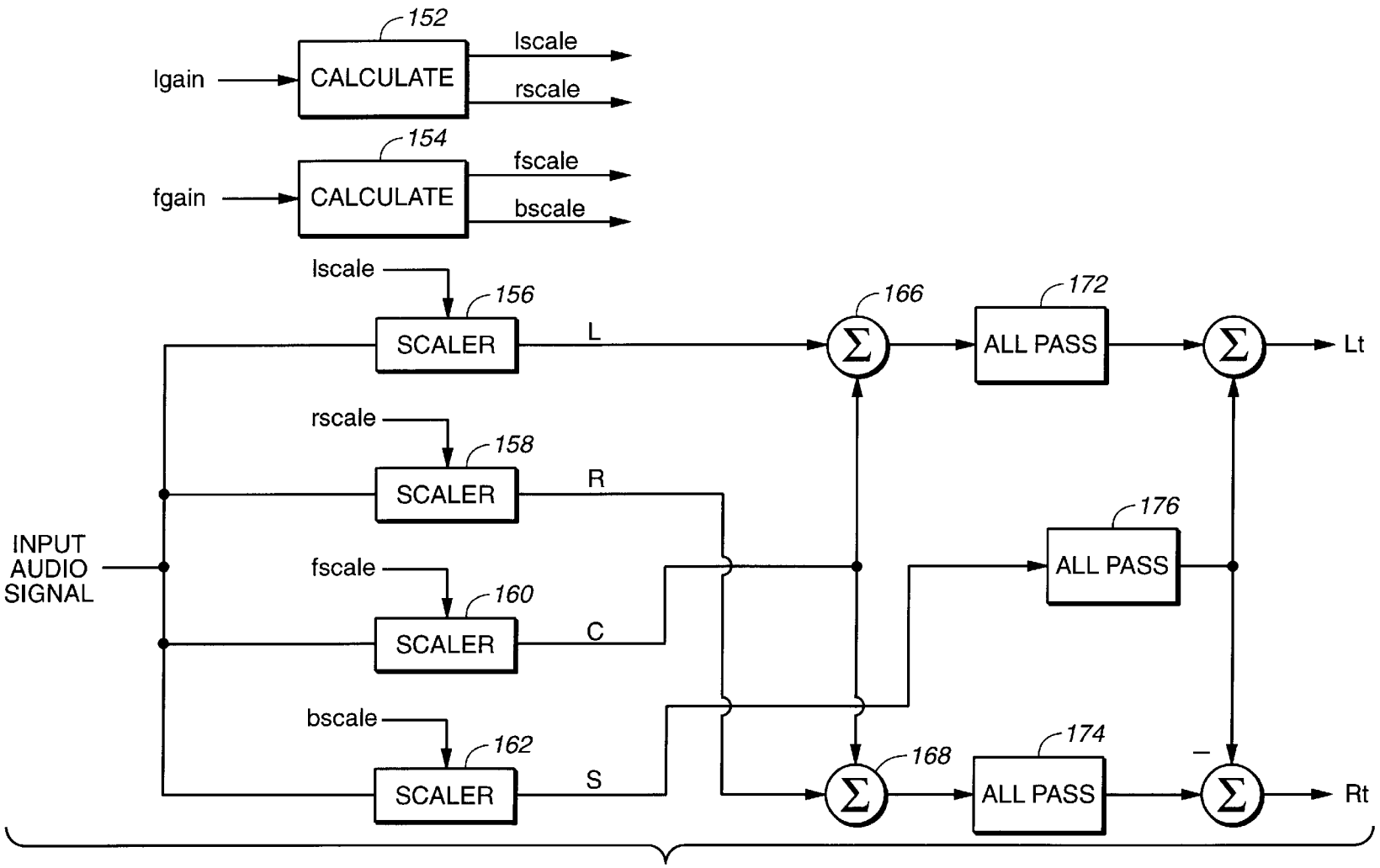
FIG. 6 is a functional block diagram of an embodiment of the panning function and fixed matrix of FIG. 4.

As in the fixed matrix embodiment of FIG. 6, control variables used as inputs to the routine are lgain, which varies from 1.0 Left to 0.0 Right, and fgain, varying from 1.0 Front to 0.0 Back. These control variables are generated, for example, by the computer game or CD ROM running on the computer or by some other source. Although the lgain and fgain control variables represent two orthogonal directions in two-dimensional space (front/back and left/right) for compatibility with Dolby Surround and Dolby Pro Logic Surround decoders, in principle they are not so limited. In their simplest and lowest processing power version, calculation functions 206 and 208, respectively, calculate four scale factors lscale, rscale, fscale, and bscale from fgain and lgain in accordance with the following relationships which describe two linear panning functions in which the division of the amplitude between left/right and front (center)/back (surround), respectively, yields a constant sum:

lscale=lgain;

rscale=1.−lscale;

fscale=fgain; and bscale=1.−fscale.

Although the four scale factors represent a spatial position relative to four directions, it should be understood that they do not have four degrees of freedom inasmuch as they are derived from control variables having only two degrees of freedom.

Calculation of the four scale factors by two linear panning functions results in encoding center and surround signals at a −6 dB level rather than −3 dB as in the classical prior art Dolby MP Matrix encoder (see FIG. 1). In this case the encoded signals may be expressed as Lt=L+0.5C+0.5jS; and Rt=R+0.5C−0.5jS, where L is the left input signal, R is the right input signal, C is the center input signal and S is the surround input signal.

In this application (adding one or more spatial effect signals to a conventionally encoded prerecorded soundtrack), the 3 dB difference (−6 dB vs. −3 dB) is likely to be inaudible to most listeners. However, if the use of additional computer processing resources is not of concern (requiring the use of multipliers rather than simply shifting the binary point), a sine/cosine panning function instead of a linear panning function may be employed to calculate lscale and rscale. Thus, in this alternative, calculation functions 206 and 208, respectively, calculate scale factors lscale, rscale, fscale, and bscale from fgain and lgain in accordance with the following relationships:

lscale=sin (lgain*pi/2);

rscale=sqrt(1.−lscale*lscale);

fscale=fgain; and bscale=1.−fscale.

In this case, the center signals are encoded at a −3 dB level and surround signals are encoded at a −6 dB level. Thus, the encoded signals may be expressed as Lt=L+0.707C+0.5jS; and Rt=R+0.707C−0.5jS.

The use of a linear panning function to calculate fscale and bscale is much less likely to be audible than with respect to lscale and rscale—but if desired, a sine/cosine panning function may also be used to calculate fscale and bscale to yield the classical Dolby MP Matrix encoding expressions:

Lt=L+0.707C+0.707jS; and

Rt=R+0.707C−0.707jS.

To avoid unduly consuming CPU cycles, scale factor calculation may be carried out only for blocks of time samples. Because the sound image position is constant for the time period of each block, if the blocks are too long in time duration, the sound image may move in perceptible jumps. Thus, the audible effect of block length must be weighed against savings in required processing power. The perception of smooth movement in the decoded sound image may also be enhanced by incrementally changing the scale factors periodically, even once per sample, without incurring seriously increased mips requirements.

The derived scale factors are used to variably matrix the derived time domain signals to obtain Lt and Rt as follows (each combination of four variables yields a different combination of Lt/Rt amplitude and Lt/Rt phase):

Lt[*i*]=lscale*fbuf[*i*]*fscale+fbuf90[*i*]*bscale;

Rt[*i*]=rscale*fbuf[*i*]*fscale−fbuf90[*i*]*bscale;

Note that lscale and rscale have no effect on fbuf90 [], so in back (fscale=0, bscale=1), there is no left/right variation.

Figure 7:
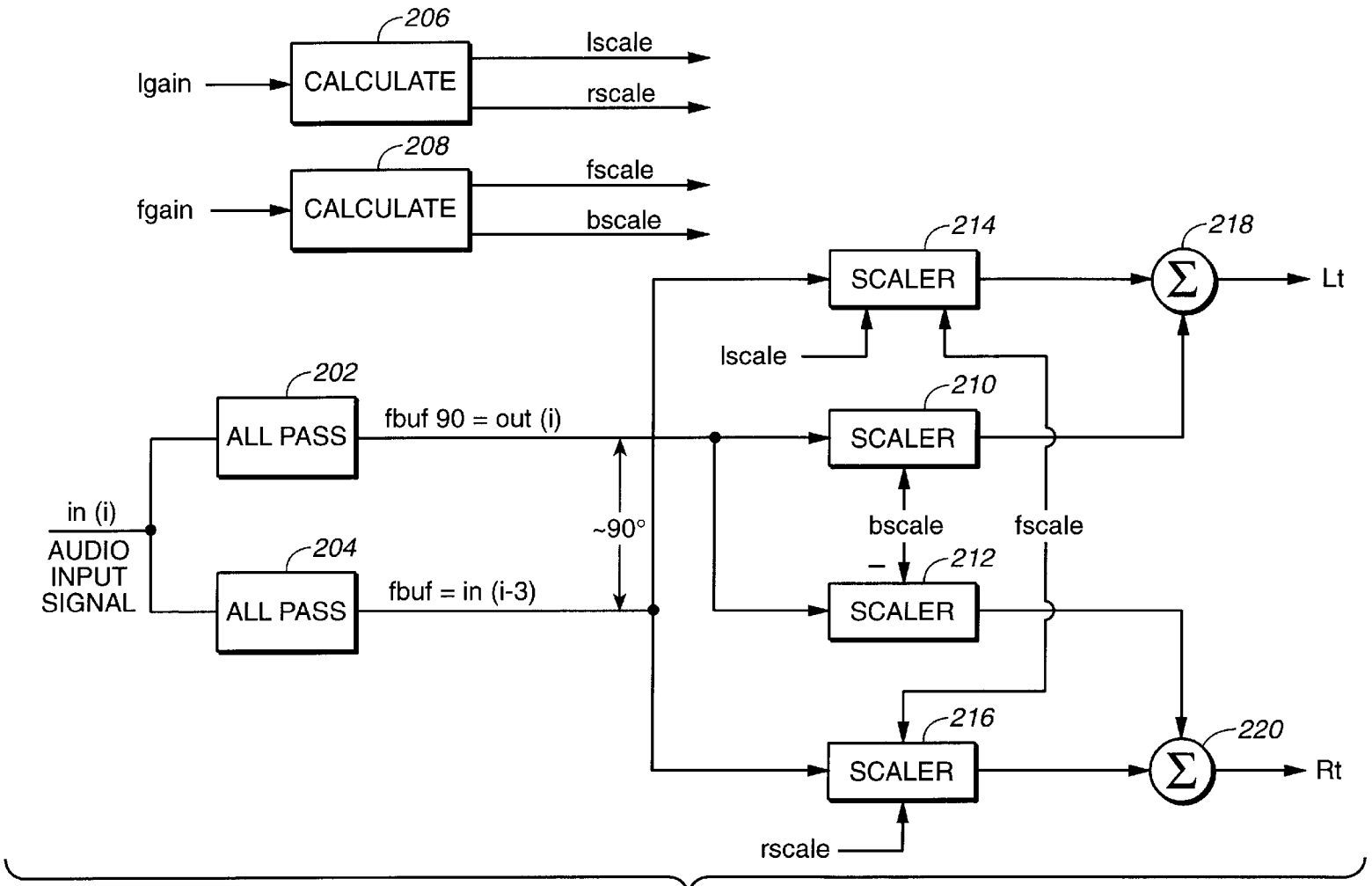
FIG. 7 is a functional block diagram of an embodiment of the variable matrix of FIG. 5.

In terms of the functional block diagram of FIG. 7, the phase shifted output fbuf90 of all pass function 202 is applied to first and second scalers 210 and 212 which multiply the fbuf90 output by the bscale scale factor, respectively, such that the bscale scaled output of function 212 is sign inverted with respect to that of function 210. This may be accomplished in many ways. One processingly economical method would be two multiplications, one by bscale and the other by minus one (in which case, block 216 includes both multiplications).

The phase shifted output fbuf of all pass function 204 is applied to first and second scalers 214 and 216 which each multiply the fbuf output by the fscale scale factor, the first scaler 214 also multiplying fbuf by the lscale scale factor and the second scaler 216 also multiplying fbuf by the rscale scale factor.

A summing function 218 adds the bscale scaled fbuf90 output to the lscale scaled fbuf output to provide the Lt output signal, while a summing function 220 adds the −bscale scaled fbuf90 output to the rscale scaled fbuf output to provide the Rt output signal.

I claim:

1. A digital audio phase-amplitude matrix encoder method for encoding a single digital audio signal in response to four scale factors representing the spatial position of said single digital audio signal relative to four directions, as first and second directionally encoded digital audio signals, comprising shifting the phase of the single digital audio signal in a first digital all-pass filter, shifting the phase of the single digital audio signal in a second digital all-pass filter, wherein the phase shift caused by said first digital all-pass filter relative to the phase shift caused by said second digital all-pass filter averages about 90 degrees within a significant frequency range of said encoded digital audio signals, scaling the first digital all-pass filter phase-shifted single digital audio signal by a first scale factor representing the position of said single digital audio signal relative to a first direction, further scaling the first digital all-pass filter phase-shifted single digital audio signal by said first scale factor, said further scaling, said first digital all-pass filter phase-shifted single digital audio signal, and said first scale factor having polarity characteristics such that the sign of the resulting first scale factor further scaled first digital all-pass filter phase-shifted single digital audio signal is inverted relative to the sign of the first scale factor scaled first digital all-pass filter phase-shifted single digital audio signal, scaling the second digital all-pass filter phase-shifted single digital audio signal by the product of a second scale factor and a third scale factor said second scale factor representing the position of said single digital audio signal relative to a second direction, said third scale factor representing the position of said single digital audio signal relative to a third direction, scaling the second digital all-pass filter phase-shifted single digital audio signal by the product of said second scale factor and a fourth scale factor said fourth scale factor representing the position of said single digital audio signal relative to a fourth direction, summing said first scale factor scaled first digital all-pass filter phase-shifted single digital audio signal and said second and third scale factor scaled second digital all-pass filter phase-shifted single digital audio signal to produce said first directionally encoded digital audio signal, and summing said first scale factor scaled sign-inverted first digital all-pass filter phase-shifted single digital audio signal and said second and fourth scale factor scaled second digital all-pass filter phase-shifted single digital audio signal to produce said second directionally encoded digital audio signal.

2. The method of claim 1 wherein said first digital all-pass filter and said second digital all-pass filter each comprise a single all-pass filter or a plurality of all-pass filters in series.

3. The method of claim 2 wherein at least one, but only one, of said all-pass filters consists of a pure time delay.

4. A digital audio phase-amplitude matrix encoder method for encoding up to four digital audio input signals each representing a spatial position in one of four directions, respectively, as first and second directionally encoded digital audio signals, comprising summing a first digital audio input signal with an attenuated second digital audio input signal to produce a first component of said first directionally encoded digital audio signal, summing a third digital audio input signal with an attenuated second digital audio input signal to produce a first component of said second directionally encoded digital audio signal, shifting the phase of the first component of said first directionally encoded digital audio signal in a first digital all-pass filter, shifting the phase of the first component of said second directionally encoded digital audio signal in a second digital all-pass filter, shifting the phase of a fourth digital audio input signal in a third digital all-pass filter, wherein the phase shift caused by each of said first and second digital all-pass filter relative to the phase shift caused by said third digital all-pass filter is about 90 degrees within a significant frequency range of said encoded digital audio signals, summing said first component of said first directionally encoded digital audio signal, with an attenuated phase-shifted fourth digital audio input signal to produce said first directionally encoded digital audio signal, and summing said first component of said second directionally encoded digital audio signal, with an attenuated phase-shifted fourth digital audio input signal to produce said second directionally encoded digital audio signal, wherein said attenuated phase-shifted fourth digital audio input signal and the summing of said second directionally encoded digital audio signal and said attenuated phase-shifted fourth digital audio input signal have polarity characteristics such that the sign of the resulting attenuated phase-shifted fourth digital audio input signal component of said second directionally encoded digital audio signal is inverted relative to the sign of the attenuated phase-shifted fourth digital audio input signal component of said first directionally encoded digital audio signal.

5. The method of claim 4 wherein said first digital all-pass filter, said second digital all-pass filter, and said second digital all-pass filter each comprise a single all-pass filter or a plurality of all-pass filters in series.

6. The method of claim 5 wherein at least one, but only one, of either both of said first and second all-pass filters or said third all-pass filters consists of a pure time delay.

* * * * *

UNITED STATES PATENT AND TRADEMARK OFFICE

CERTIFICATE OF CORRECTION

PATENT NO. : 5,862,228
APPLICATION NO. : 08/803676
DATED : January 19, 1999
INVENTOR(S) : Mark Franklin Davis It is certified that error appears in the above-identified patent and that said Letters Patent is hereby corrected as shown below:

On the Title Page, Item (56)
Page 2 of Title page under U.S. Patent Documents of the patent, the patent authored by Okada et al. Patent No. "5,095,787" should be chagned to --5,095,798--.

Signed and Sealed this

Seventeenth Day of July, 2007

JON W. DUDAS
*Director of the United States Patent and Trademark Office*